US011097936B2

(12) United States Patent
Zerilli

(10) Patent No.: US 11,097,936 B2
(45) Date of Patent: Aug. 24, 2021

(54) APPARATUS FOR PREPARING AND DISPENSING A DILUTED BEVERAGE

(71) Applicant: ZERICA S.R.L., Palermo (IT)

(72) Inventor: Marco Zerilli, Palermo (IT)

(73) Assignee: ZERICA S.R.L., Palermo (IT)

( * ) Notice: Subject to any disclaimer, the term of this patent is extended or adjusted under 35 U.S.C. 154(b) by 0 days.

(21) Appl. No.: 16/955,401

(22) PCT Filed: Dec. 20, 2018

(86) PCT No.: PCT/IB2018/060436
§ 371 (c)(1),
(2) Date: Jun. 18, 2020

(87) PCT Pub. No.: WO2019/123373
PCT Pub. Date: Jun. 27, 2019

(65) Prior Publication Data

US 2021/0009398 A1 Jan. 14, 2021

(30) Foreign Application Priority Data

Dec. 22, 2017 (IT) ..... 102017000149066

(51) Int. Cl.
*B67D 1/00* (2006.01)
*B67D 1/08* (2006.01)
*B67D 1/12* (2006.01)

(52) U.S. Cl.
CPC ..... *B67D 1/0031* (2013.01); *B67D 1/0032* (2013.01); *B67D 1/0888* (2013.01); *B67D 1/122* (2013.01); *B67D 1/1284* (2013.01)

(58) Field of Classification Search
CPC .. B67D 1/0031; B67D 1/0032; B67D 1/0888; B67D 1/122; B67D 1/1284; B67D 1/004; B67D 1/0043; B67D 1/14
See application file for complete search history.

(56) References Cited

U.S. PATENT DOCUMENTS 3,310,203 A * 3/1967 McCann ..... B67D 1/0043 222/54
4,955,507 A 9/1990 Kirschner et al.
(Continued)

FOREIGN PATENT DOCUMENTS

EP 1688686 A2 8/2006
JP 2002 230636 A 8/2002
(Continued)

*Primary Examiner* — Donnell A Long
(74) *Attorney, Agent, or Firm* — R. Neil Sudol; Henry D. Coleman

(57) ABSTRACT

Apparatus for preparing and dispensing a diluted beverage has a mains water inlet, a valve for opening or shutting water flow, a food concentrate container, an outlet for the beverage, a user interface for commanding dispensing of the beverage, and a volumetric pump communicating with the valve outlet and the beverage outlet for drawing and mixing the food concentrate and water. A first conduit is connected to an outlet of the food concentrate container and the volumetric pump inlet. A second conduit communicating with the valve outlet and an intermediate portion of the first conduit. A control unit activates the valve and the volumetric pump. The second conduit has a section narrowing for regulating the outflow velocity of the water entering the first conduit. The control unit activates the volumetric pump to regulate the flow of food concentrate mixture and water in response to data from a water flow detector.

9 Claims, 2 Drawing Sheets

(56) References Cited

U.S. PATENT DOCUMENTS 5,137,061 A * 8/1992 Deininger ..... B67D 1/10 141/18
6,276,150 B1 * 8/2001 Nelson ..... F25B 41/20 62/177
7,784,205 B1 * 8/2010 Baron ..... G09F 13/04 40/564
7,918,156 B2 * 4/2011 Greenwald ..... A47J 31/465 99/275
2005/0133531 A1 * 6/2005 Crisp, III ..... B67D 1/04 222/129.1
2012/0228328 A1 * 9/2012 Ryan ..... B67D 1/0025 222/129.4
2012/0230148 A1 * 9/2012 van Opstal ..... B01F 7/00216 366/167.1
2013/0062366 A1 * 3/2013 Tansey ..... B67D 1/0021 222/102
2014/0053911 A1 * 2/2014 Shaw ..... B67D 1/0884 137/3
2015/0197416 A1 * 7/2015 Hoover ..... B67D 1/0021 222/1
2016/0368752 A1 12/2016 Bethuy et al.
2017/0064977 A1 * 3/2017 Bischel ..... B67D 1/0036
2017/0088410 A1 * 3/2017 Wing ..... B67D 1/0022
2017/0253473 A1 9/2017 Melville, Jr. et al.
2017/0313566 A1 * 11/2017 Makino ..... B67D 1/004
2018/0155176 A1 * 6/2018 Cook ..... B67D 1/0016
2018/0317524 A1 * 11/2018 Jennings, III ..... B01F 3/04808
2019/0185311 A1 * 6/2019 Karol ..... B67D 1/0081
2020/0079638 A1 * 3/2020 Nishimura ..... B67D 1/12
2021/0030197 A1 * 2/2021 Vetterli ..... B67D 1/0888

FOREIGN PATENT DOCUMENTS

JP 2006 243964 A 9/2006
WO WO 2014/036117 A1 3/2014
WO WO 2014/036127 A1 3/2014
WO WO 2016/198966 A1 12/2016

* cited by examiner

APPARATUS FOR PREPARING AND DISPENSING A DILUTED BEVERAGE

FIELD OF THE INVENTION

The present invention relates to the technical sector of preparing and dispensing machine of diluted beverages used, for example, in hotels or offices and commonly known as "product dispensers".

DESCRIPTION OF THE PRIOR ART

The expression "diluted beverage" is taken to mean a generic food concentrate mixture obtained by mixing a comestible liquid, in the particular case water, and a food concentrate mixture, either a liquid or a suspension, such as for example: a syrup; a purée, condensed milk; or, more commonly, a fruit-based food concentrate in which the water content has been reduced so as to obtain a product richer in dry substance.

A preparing and dispensing machine of a diluted beverage (1) of known type is illustrated in FIG. 1 and comprises: a water inlet (2) to be connected to the municipal water supply; a valve (3) which has an inlet (4) of the valve (3) in fluid communication with the water inlet (2), and an outlet (5) of the valve (3) and which is activatable for enabling or shutting down the flow of water coming from the water inlet (2) (represented by an arrow in FIG. 1); a food concentrate mixture container (6) which has an outlet of food concentrate mixture (7); and an outlet of diluted beverage (8); a user interface (9) for commanding dispensing of a diluted beverage; and a volumetric pump (10) for aspirating internally thereof the food concentrate mixture and water, and for mixing them with one another. The volumetric pump (10) is electrical and has an inlet (12) of the volumetric pump (10) and an outlet (11) of the volumetric pump (10) which is in fluid communication with the valve (3) outlet (5) and with the diluted beverage (8) outlet.

The preparing and dispensing machine of a diluted beverage (1) further comprises a first conduit (13); a second conduit (16); a third conduit (28); a fourth conduit (31) and a dispensing conduit (25). The first conduit (13) in turn comprises: a first end (14) which is connected to the outlet of the food concentrate mixture (7); and a second end (15) which is connected to the inlet (12) of the volumetric pump (10). The second conduit (16) comprises: a third end (17) which is in fluid communication with the outlet (5) of the valve (3); and a fourth end (18) which is connected to an intermediate portion (19) of the first conduit (13). The dispensing conduit (25) in turn comprises: a fifth end (26) which is connected to the outlet (11) of the volumetric pump (10); and a sixth end (27) which is open to the atmosphere in order to dispense the diluted beverage towards the outside. The third conduit (28) in turn comprises: a seventh end (29) which is connected to an intermediate portion (34) of the dispensing conduit (25); and an eighth end (30) in fluid communication with the outlet (5) of the valve (3). The fourth conduit (31) in turn comprises: a ninth end (32) which is connected to the third end (17) and the eighth end (30); and a tenth end (33) which is connected to the outlet (5) of the valve (3).

The preparing and dispensing machine of a diluted beverage (1), further comprising: a choke valve (24) which is mounted along the second conduit (16) to regulate the quantity of water which crosses the second conduit (16) coming from the outlet (5) of the valve (3); and control means (20) which activate the valve (3) and the volumetric pump (10), each time the user requests a diluted beverage.

On the act of installation of a preparing and dispensing machine of a diluted beverage (1) such as the one described in the foregoing, once the power and aspiration of the volumetric pump (10) is known, and the dilution ratio to be obtained has been established, i.e. the ratio between the quantity of water and the quantity of food concentrate mixture to be mixed to obtain the diluted beverage, the choke valve (24) must be calibrated, so that a predetermined percentage of the water flow in outlet from the outlet (5) of the valve (3) is sent to the first conduit (13) through the second conduit (16). The remaining part of the water in outlet from the outlet (5) of the valve (3) will instead flow in the dispensing conduit (25) via the third conduit (28).

In detail, to calibrate the choke valve (24), once the dilution ratio to be obtained is established, the following is necessary: detecting the water flow which, from the municipal water supply, flows towards the outlet (5) of the valve (3); and, on the basis of this water flow and the aspirating power of the volumetric pump (10), regulating the quantity of water that is to be sent to the first conduit (13), so that the water flow is such as to constitute, together with the water reaching the dispensing conduit (25) through the third conduit (28), the quantity of water necessary for obtaining the chosen dilution ratio; and at the same time, the water flow should be sufficient to appropriately dilute the food concentrate mixture which from the first conduit (13) is aspirated internally of the volumetric pump (10).

The above-described calibration operations of the choke valve (24) are manually carried out by an operator, using a knob (26) of the choke valve (24), when the preparing and dispensing machine of a diluted beverage (1) is installed, and are repeated each time the dilution ratio to be obtained changes. These operations are carried out taking into account the conditions of the municipal water supply, in terms of flow rate and pressure, at the moment of installation or at a time when the dilution ratio to be obtained changes; however the conditions of the municipal water supply in terms of pressure and flow rate vary continuously due to many factors such as, for example, the change in the number of users effectively using the municipal water supply or sharp changes in the pressure of the municipal water supply itself, or other reasons, so that each time the conditions of the municipal water supply change, the flow of water that from the municipal water supply flows towards the outlet (5) of the valve (3) changes, causing undesired alterations in the dilution ratio of the diluted beverage with consequent changes in the flavour thereof.

To avoid this, the choke valve (24) should be regulated manually each time there are changes in the conditions of the municipal water supply in terms of flow rate or pressure. However, as there are continuous variations that depend on a multiplicity of causes that are not predictable, it is practically not feasible to regulate the choke valve (24) each time changes occur. Therefore, to date a preparing and dispensing machine of a diluted beverage (1) such as the one illustrated in FIG. 1 and described in the foregoing, dispenses a diluted beverage, the dilution ratio and therefore the flavour of which can change from one dispensing to another in response to the variations of the conditions of the municipal water supply in terms of pressure and flow rate.

Other drawbacks of the preparing and dispensing machine of a diluted beverage (1) of the prior art are: the need for periodical maintenance on the choke valve (24) to keep it functioning properly; and the fact that each choke valve (24) enables regulating the quantity of water to be passed through it within a determined flow range, which depends on the technical specifications of the choke valve (24) itself. Therefore the limit in the flow rate range that can pass through the choke valve, together with the fact that the volumetric pump (10), given the supply voltage thereto, will have a certain fixed aspiration power, means that a preparing and dispensing machine of a diluted beverage (1) of the prior art can, at the present time, be used only for those diluted beverages where a dilution ratio varies between 8 and 16 brix.

SUMMARY OF THE INVENTION

In the light of the foregoing, the aim of the present invention consists in obviating the above-mentioned drawbacks.

The above aim is attained by a preparing and dispensing machine of a diluted beverage according to claim 1.

In the preparing and dispensing machine of a diluted beverage according to the invention, the detecting unit detects the water flow which from the municipal water supply flows towards the outlet of the valve, each time a dispensing of a diluted beverage is commanded, and transmits the data to the control means; the control means, once the water flow is known as well as the technical characteristics of the second conduit (diameter, length and pathway), assess the quantity of water which will flow from the outlet of the valve into the first conduit and on the basis of this will vary the power supply to the volumetric pump so as to modulate the functioning thereof in terms of number of revolutions and thus flow rate of liquid to be aspirated, in response to the oscillations of water flow rate from the municipal water supply towards the water inlet.

In this way it is possible to obtain and maintain the dilution ratio independently of the conditions of the municipal water supply and with very much more precision with respect to prior-art machines.

Further, as the preparing and dispensing machine of a diluted beverage of the invention no longer includes the choke valve with the limitations associated thereto in terms of quantity of water that can cross it, and as it enables regulating the volumetric pump as a function of the data received by the detecting unit, it will be usable for a broader range of values of the dilution ratio. In particular, the preparing and dispensing machine of a diluted beverage of the invention advantageously enables preparing and dispensing beverages characterised by a dilution ratio which can vary within a much broader brix range with respect to the known art, and substantially for all types of diluted beverage available on the market.

BRIEF DESCRIPTION OF THE DRAWINGS

Specific embodiments of the invention will be described in the following part of the present description, according to what is set down in the claims and with the aid of the accompanying tables of drawings, in which:

DESCRIPTION OF THE PREFERRED EMBODIMENTS

Figure 1:
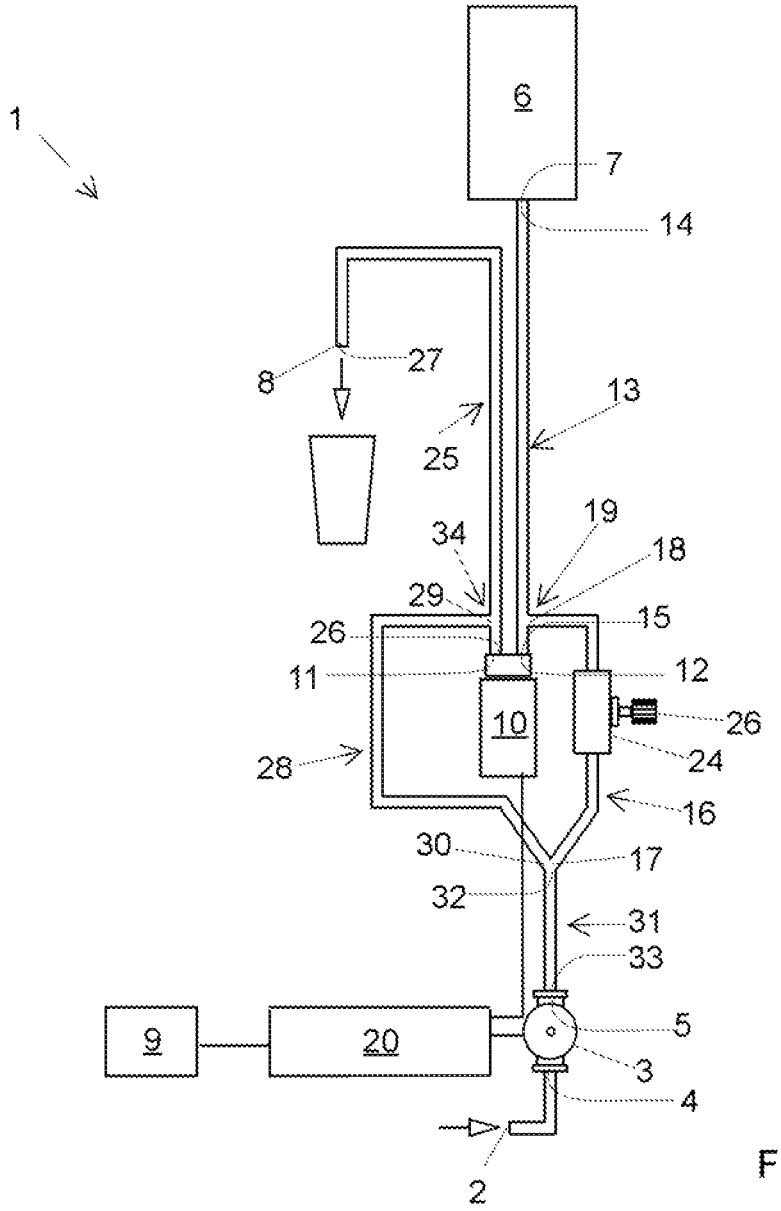
FIG. 1 schematically illustrates a preparing and dispensing machine of a diluted beverage of known type.
Figure 2:
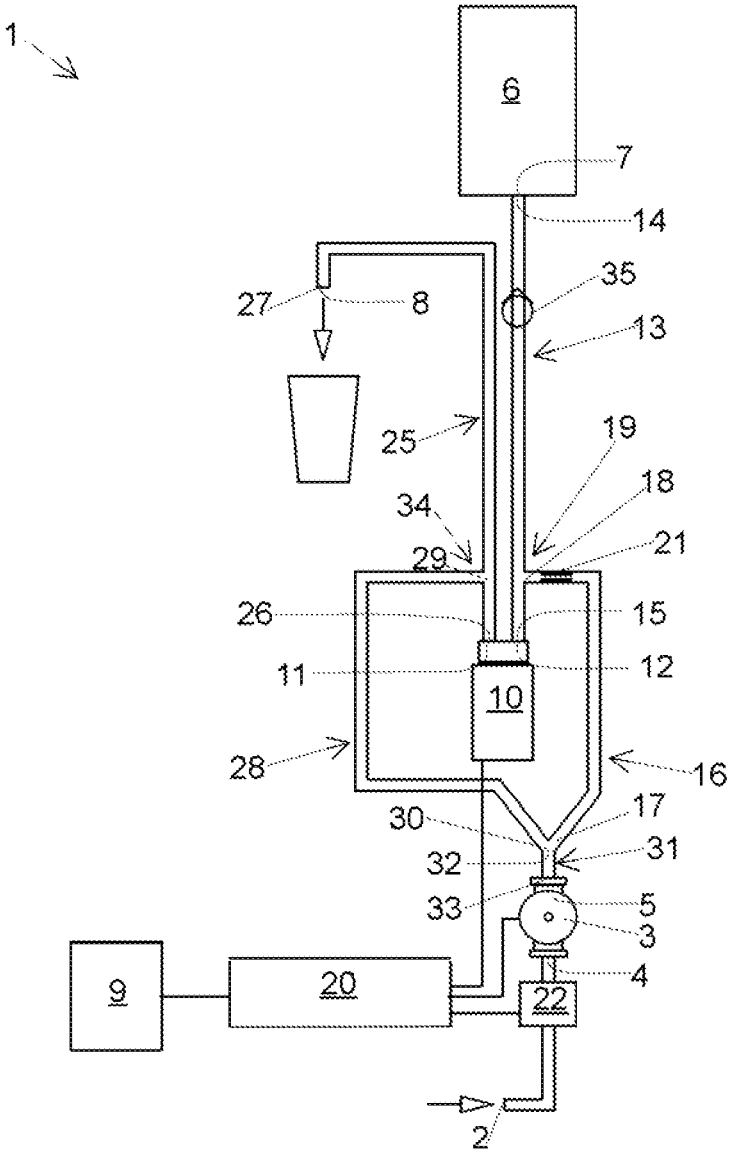
FIG. 2 schematically illustrates a preparing and dispensing machine of a diluted beverage, object of the invention.

With reference to FIG. 2, reference numeral (1) denotes a preparing and dispensing machine of a diluted beverage, object of the present invention.

The preparing and dispensing machine of a diluted beverage (1) comprises: a water inlet (2) to be connected to the municipal water supply; a valve (3) which has an inlet (4) of the valve (3) in fluid communication with the water inlet (2), which has an outlet (5) of the valve (3) and which is activatable for enabling or shutting down the flow of water coming from the water inlet (2).

Still with reference to FIG. 2, the preparing and dispensing machine of a diluted beverage (1) comprises a food concentrate mixture container (6) which has an outlet of food concentrate mixture (7); an outlet of diluted beverage (8); a user interface (9) for commanding dispensing of a diluted beverage; and a volumetric pump (10) for aspirating internally thereof the food concentrate mixture and water, and for mixing them with one another. The volumetric pump (10) has an inlet (12) of a volumetric pump (10) and an outlet (11) of the volumetric pump (10) which is in fluid communication with the valve (3) outlet (5) and with the diluted beverage (8) outlet.

Still with reference to FIG. 2, the preparing and dispensing machine of a diluted beverage (1) further comprises: a first conduit (13) and a second conduit (16). The first conduit (13) in turn comprises: a first end (14) which is connected to the outlet of the food concentrate mixture (7); and a second end (15) which is connected to the inlet (12) of the volumetric pump (10). The second conduit (16) in turn comprises: a third end (17) which is in fluid communication with the outlet (5) of the valve (3); and a fourth end (18) which is connected to an intermediate portion (19) of the first conduit (13).

Further, the preparing and dispensing machine of a diluted beverage (1) comprises control means (20) which activate the valve (3) and the volumetric pump (10).

The second conduit (16) comprises a section narrowing (21) for regulating the outflow velocity of the water in inlet into the first conduit (13).

The preparing and dispensing machine of a diluted beverage (1) further comprises a detecting unit (22) of the water flow for detecting the quantity of water flowing from the water inlet (2). The detecting unit (22) is connected to the control means (20) in order to transmit the data detected to the control means (20).

The control means (20) are configured to activate the volumetric pump (10) so as to regulate the flow of food concentrate mixture and water aspirated internally thereof as a function of the data received by the detecting unit (22).

With particular reference to FIG. 2, the section narrowing (21) is dimensioned so that the section of the second conduit (16) at the mouth of the first conduit (13) is not so big as to induce, in the first conduit (13), an excessive quantity of water, with the consequent risk that the volumetric pump (10), by aspirating, attracts internally thereof only water and, at the same time, is not so small as to induce in the first conduit (13) an irrelevant quantity, or at the limit even no water, with the consequent risk that the volumetric pump (10), by aspirating, attracts only food concentrate mixture.

The section narrowing (21) is represented in FIG. 2 in proximity of the opening of the second conduit (16) in the first conduit (13), but might also be located at any other point in the second conduit (16).

The section narrowing (21) is preferably located in proximity of or at the fourth end (18) in order to increase the water outflow velocity in inlet into the first conduit (13).

In particular, the presence of the section narrowing (21) at the water opening in the first conduit (13) which, by increasing the water outflow velocity, induces swirling in the water and thus a change to turbulence in the water itself, accelerates and facilitates the mixing between water and food concentrate mixture in the first conduit (13). In this way, and advantageously, the volumetric pump (10) aspirates the food concentrate mixture diluted with the water and thus much more fluid, by reducing the force that the volumetric pump (10) has to exert to aspirate the food concentrate mixture, with a consequent increase in the working life of the volumetric pump (10).

The control means (20) for activating the volumetric pump (10) can activate an electromechanical actuator, which in turn can activate the shaft of the volumetric pump (10).

The control means (20) can be configured to periodically command the washing of the preparing and dispensing machine of a diluted beverage (1), so as to guarantee respect for health standards. In detail, to carry out the washing operation of the preparing and dispensing machine of a diluted beverage (1), the control means (20) activate the valve (3) so as to circulate the water internally of the various conduits of the preparing and dispensing machine of a diluted beverage (1), leaving the volumetric pump (10) deactivated.

The volumetric pump (10) is preferably an electric pump; and the control means (20) are configured for varying supply voltage to the volumetric pump (10) as a function of data received from the detecting unit (22) so as to control the flow of food concentrate mixture and water aspirated internally thereof.

In detail, on varying the electric power supply voltage to the volumetric pump (10), the number of revolutions that the volumetric pump (10) performs also varies in the unit of time and thus the aspirating power of the volumetric pump (10) also changes.

The volumetric pump (10) can comprise internally thereof a mixing chamber (not illustrated) for mixing the water and the food concentrate mixture which is aspirated. The mixing takes place, therefore, in hermetic conditions, advantageously reducing the risk of contamination from the outside.

The preparing and dispensing machine of a diluted beverage (1) preferably comprises a second user interface (not illustrated) predisposed for receiving the data relating to the dilution ratio and for transmitting the data to the control means (20).

Each time the type of food concentrate mixture used, or in any case each time, for any reason, the dilution ratio is to be changed, the operator can advantageously easily transmit the data relating to the new dilution ratio to be obtained to the control means (20) via the second user interface.

The control means (20) can be set so that by taking account of the characteristics of the hydraulic circuit, which are a constant in the system, and having received the data relating to the dilution ratio that is to be obtained, they are able, using appropriate formulas, to assess the quantity of food concentrate mixture to be aspirated and thus, as a function of this, the activating voltage to be supplied to the volumetric pump (10).

In a preferred embodiment of the invention, the second user interface can coincide with the user interface (9) utilised for commanding dispensing of a diluted beverage. In detail, in this case the user interface (9) can, for example, include an appropriate menu protected by a password, which only enables the authorised operator to enter the data to be transmitted to the control means (20).

Alternatively the second user interface can be different to the user interface utilised for commanding dispensing of a diluted beverage. In particular, the second user interface can be arranged in a remote location and be predisposed to transmit the data to the control means via a wireless connection, so as to enable a control of the functioning of the preparing and dispensing machine of a diluted beverage (1) even from a remote position, or it can be arranged on the preparing and dispensing machine of a diluted beverage (1) or in proximity thereof, for example, at an easily-accessible point for the authorised operators but not for the users of the preparing and dispensing machine of a diluted beverage (1).

In an embodiment that is not illustrated, the food concentrate mixture container (7) can comprise, on an external surface thereof, an identification code which comprises the data relating to the dilution ratio of the food concentrate mixture contained internally thereof; and the preparing and dispensing machine of a diluted beverage (1) can further comprise detecting means (not illustrated) for detecting the data comprised in the identification code and for transmitting the data to the control means (20).

The control means (20) advantageously receive all the data necessary in a totally automatic way with no need for an operator to enter the data manually, with a consequent reduction of working times and labour costs.

The food concentrate mixture is in fact generally packed in appropriate containers of food concentrate mixture (6) on which there is generally an identification code comprising, among the various items of information, the data relating to the dilution ratio recommended by the producer; so that the detecting means, by reading that data, can transmit them to the control means (20) which, possibly following due processing, will have available all the information required to appropriately activate the volumetric pump (10).

The detecting means can comprise any means able to read the identification code located on the food concentrate mixture container (6). In detail, the detecting means can be optical reading means, such as tv cameras or sensors, or radio-frequency detecting means, such as for example RFID, NFC or contactless reading means, or cabled reading means.

The detecting means can preferably be located in the vicinity of the food concentrate mixture container (6).

In an embodiment that is not illustrated, the food concentrate mixture container (6) can comprise, on an external surface thereof, an identification code which comprises the data relating to the dilution ratio of the food concentrate mixture contained internally thereof; and the preparing and dispensing machine of a diluted beverage (1) can comprise both detecting means for detecting the data comprised in the identification code and for transmitting the data to the control means (20) and a second user interface for receiving the data relating to the dilution ratio and transmitting the data to the control means (20).

In this way, the control means (20) automatically receive, from the detecting means, the data relating to the dilution ratio recommended by the producer of the food concentrate mixture necessary for activating the volumetric pump (10) appropriately. However, if, for any reason, for example the user's preferences, a dilution ratio is desired that is different to the recommended ratio, it is possible to act manually, via the second user interface, by modifying the data relative to the dilution ratio to be transmitted to the control means (20).

There will advantageously be greater freedom in the choice of the dilution ratio, without losing the advantage of automatic programming of the control means (20).

In a preferred embodiment of the invention, the detecting unit (22) of the water flow is preferably a flow rate counter, interposed between the water inlet (2) and the inlet (4) of the valve (3).

In particular, the flow rate counter, represented schematically in FIG. 2, detects the litres per second of water crossing, in the unit of time, a section in proximity of the inlet (4) of the valve (3), directly providing the control means (20) with the data regarding the quantity of water flowing towards the preparing and dispensing machine of a diluted beverage (1).

Alternatively the detecting unit (22) of the water flow can be a device able to detect the velocity or pressure of the water entering from the water inlet (2). In this case, the control means (20) can, for example, process the data received from the detecting unit (22) of the flow rate in order to calculate the quantity of water in inlet into the preparing and dispensing machine of a diluted beverage (1).

In a preferred embodiment of the invention, the valve (3) is an electrovalve.

Further, the valve (3) is preferably a single-acting valve (3), i.e. a valve (3) which, if activated to enable passage of water, can be crossed by a water flow running exclusively from the inlet (4) of the valve (3) towards the outlet (5) of the valve (3).

The preparing and dispensing machine of a diluted beverage (1) of any one of the preceding claims preferably comprise a non-return valve (35) which is mounted along the first conduit (13), in proximity of the food concentrate mixture container (6), for preventing passage of water from the first conduit (13) towards the outlet of food concentrate mixture (7).

In other words, the non-return valve (35) is arranged closer to the food concentrate mixture container (6) with respect to the intermediate portion (18) of the first conduit (13), so as to prevent the water in inlet in the first conduit (13) at the intermediate portion (18) of the first conduit (13) from flowing towards the outlet of the food concentrate mixture container (7). In fact, the water inlet into the food concentrate mixture container (6) would alter the characteristics of the food concentrate mixture in terms of degree of dilution.

Further, the non-return valve (35), by preventing the water flow from the first conduit (13) towards the food concentrate mixture container (6), advantageously enables carrying out the washing operations of the preparing and dispensing machine of a diluted beverage (1), without any need to remove the food concentrate mixture container (6), with a consequent time saving.

Further, the control means (20) are configured for varying supply voltage to the volumetric pump (10) as a function of the data received by the detecting unit (22) so as to control the velocity with which the food concentrate mixture and the water, mixed with one another internally of the volumetric pump (10), flow out of the volumetric pump (10) via the outlet (11) of the volumetric pump (10).

It will advantageously be possible in this way to check the dispensing velocity of the beverage, thus preventing unexpected jets of dispensing or leakage of the beverage from the container into which the beverage is to be dispensed.

With particular reference to FIG. 2, in a preferred embodiment the preparing and dispensing machine of a diluted beverage (1) described in the foregoing further comprises: a dispensing conduit (25) for dispensing a diluted beverage; a third conduit (28) and a fourth conduit (31). The dispensing conduit (25) in turn comprises: a fifth end (26) which is connected to the outlet (11) of the volumetric pump (10); and a sixth end (27) for dispensing the diluted beverage towards the outside. The third conduit (28) in turn comprises: a seventh end (29) which is connected to an intermediate portion (34) of the dispensing conduit (25); and an eighth end (30) in fluid communication with the outlet (5) of the valve (3). The fourth conduit (31) in turn comprises: a ninth end (32) which is connected to the third end (17) and the eighth end (30); and a tenth end (33) which is connected to the outlet (5) of the valve (3).

In detail, the third conduit (28) and the second conduit (16) are designed so that the water in arrival from the outlet (5) of the valve (3) is divided between the second conduit (16) and the third conduit (28). In still greater detail, the second conduit (16) and the third conduit (28) are designed so that only a minimum percentage of the water flow in outlet from the outlet (5) of the valve (3) reaches the first conduit (13) through the second conduit (16) and the fourth conduit (31), and the remaining part of the water in outlet from the outlet (5) of the valve (3) flows towards the dispensing conduit (25), through the third conduit (28) and the fourth conduit (31). In this way, the volumetric pump (10) will have to aspirate only a minimum quantity of water, mixed with the food concentrate mixture, so a small-size volumetric pump (10) can be used to guarantee high aspiration precision at modest costs.

The volumetric pump (10) is designed to create a depression internally of the first conduit (13) so as to attract internally thereof a certain quantity of water and food concentrate mixture, and to enable pressurised outlet of the food concentrate mixture and water, following the mixing thereof, through the outlet (11) of the volumetric pump (10). The water and the food concentrate mixture, mixed together and once having passed in outlet from the volumetric pump (10), flow into the dispensing conduit (25) together with the water in arrival from the third conduit (28) so as to form, together with the water coming from the third conduit (28), the diluted beverage requested by the user, which flows outwards via the diluted beverage outlet (8).

The invention claimed is:

1. A preparing and dispensing machine of a diluted beverage, comprising:

a water inlet to be connected to the municipal water supply;

a valve which has an inlet of the valve in fluid communication with the water inlet, which has an outlet of the valve and which is activatable for enabling or shutting down the flow of water coming from the water inlet;

a food concentrate mixture container which has an outlet of food concentrate mixture;

an outlet of diluted beverage;

a user interface for commanding dispensing of a diluted beverage;

a volumetric pump for aspirating internally thereof the food concentrate mixture and water, and for mixing them with one another, which has an inlet of the volumetric pump and an outlet of the volumetric pump;

a first conduit which comprises: a first end which is connected to the outlet of the food concentrate mixture; and a second end which is connected to the inlet of the volumetric pump;

a second conduit which comprises: a third end which is in fluid communication with the outlet of the valve; and a fourth end which is connected to an intermediate portion of the first conduit;

control means which activate the valve and the volumetric pump;

a dispensing conduit for dispensing a diluted beverage which comprises: a fifth end which is connected to the outlet of the volumetric pump; and a sixth end which is connected to the outlet of diluted beverage in order to dispense the diluted beverage towards the outside;

a third conduit which comprises: a seventh end which is connected to an intermediate portion of the dispensing conduit; and an eighth end which is in fluid communication with the outlet of the valve;

wherein:

the second conduit comprises a section narrowing for regulating the outflow velocity of the water in inlet into the first conduit;

it comprises a detecting unit of the water flow for detecting the quantity of water flowing from the water inlet, which detecting unit of the water flow is connected to the control means;

the control means are configured to activate the volumetric pump so as to regulate the flow of food concentrate mixture and water aspirated internally thereof as a function of the data received by the detecting unit.

2. The preparing and dispensing machine of a diluted beverage of claim 1, wherein the section narrowing is located in proximity of or at the fourth end for increasing the water outflow velocity in inlet into the first conduit.

3. The preparing and dispensing machine of a diluted beverage of claim 1, wherein: the volumetric pump is an electric pump and the control means are configured for varying supply voltage to the volumetric pump as a function of data received from the detecting unit so as to control the flow of food concentrate mixture and water aspirated internally thereof.

4. The preparing and dispensing machine of a diluted beverage of claim 1, wherein it comprises a second user interface predisposed for receiving the data relating to the dilution ratio and for transmitting the data to the control means.

5. The preparing and dispensing machine of a diluted beverage of claim 1, wherein: the food concentrate mixture container comprises, on an external surface thereof, an identification code which comprises the data relating to the dilution ratio of the food concentrate mixture contained internally thereof; and it comprises detecting means for detecting the data comprised in the identification code and for transmitting the data to the control means.

6. The preparing and dispensing machine of a diluted beverage of claim 1, wherein the detecting unit of the water flow is a flow rate counter, interposed between the water inlet and the inlet of the valve.

7. The preparing and dispensing machine of a diluted beverage of claim 1, wherein the valve is an electrovalve.

8. The preparing and dispensing machine of a diluted beverage of claim 1, comprising a non-return valve which is mounted along the first conduit, in proximity of the outlet of food concentrate mixture, for preventing passage of water from the first conduit towards the outlet of food concentrate mixture.

9. The preparing and dispensing machine of a diluted beverage of claim 1, wherein the control means are configured for varying supply voltage to the volumetric pump as a function of the data received by the detecting unit so as to control the velocity with which the food concentrate mixture and the water, mixed with one another internally of the volumetric pump, flow out of the volumetric pump via the outlet of the volumetric pump.

* * * * *